United States Patent [19]

Morimoto et al.

[11] 4,283,465

[45] Aug. 11, 1981

[54] POROUS BODY OF ALUMINUM OR ITS ALLOY AND A MANUFACTURING METHOD THEREOF

[75] Inventors: Toru Morimoto, Ichikawa; Tsuyoshi Ohsaki; Toshio Ohkawa, both of Narashino; Kenji Matsuzawa, Yokohama, all of Japan

[73] Assignee: Nippon Dia Clevite Co., Ltd., Narashino, Japan

[21] Appl. No.: 936,151

[22] Filed: Aug. 23, 1978

[30] Foreign Application Priority Data

Sep. 7, 1977 [JP] Japan ..... 52-106822

[51] Int. Cl.[3] ..... H01F 3/02

[52] U.S. Cl. ..... 428/566; 428/567; 75/200; 75/222; 75/224; 75/214; 181/294

[58] Field of Search ..... 428/566, 567; 75/222, 75/200, 224, 214; 181/291, 294; 148/126, 127

[56] References Cited

U.S. PATENT DOCUMENTS

| | | | |
|---|---|---|---|
| 3,728,089 | 4/1973 | Segawa et al. | 428/566 |
| 3,961,945 | 6/1976 | Sanders et al. | 75/249 X |
| 4,039,298 | 8/1977 | Anthony et al. | 428/567 |
| 4,177,069 | 12/1979 | Kobayashi et al. | 75/213 |

*Primary Examiner*—Brooks H. Hunt
*Assistant Examiner*—J. L. Barr
*Attorney, Agent, or Firm*—Sughrue, Mion, Zinn, Macpeak and Seas

[57] ABSTRACT

A porous sintered material of good permeability and effective sound absorbability, being formed by combining between particles of aluminum or aluminum alloy powder into a body by means of sintering and having connecting pores among the particles of said aluminum or aluminum alloy powder. Said porous sintered material is obtained by mixing aluminum or an aluminum alloy with a low melting point aluminum alloy, forming the mixture into the predetermined shape and sintering it at a temperature which is at least 10° C. lower than the melting point of the base material and higher than that of the low melting point material.

11 Claims, 6 Drawing Figures

POROUS BODY OF ALUMINUM OR ITS ALLOY AND A MANUFACTURING METHOD THEREOF

BACKGROUND OF THE INVENTION

1. Field of the Invention

This invention is related to a porous body of aluminum or an aluminum alloy (hereinafter referred to simply as an Al material) and a manufacturing method thereof, especially to a porous body of an Al material being excellent in weatherproof property, heatproof property, and mechanical strength and still more being usable as a sound absorbing material which can fully absorb even such a high frequency sound as occurs from a high speed electric car on the Shinkansen as well as various kinds of filters, and a manufacturing method of said porous body.

2. Description of the Prior Art

A porous body made of a sintered metal or alloy of copper powder, iron powder, etc. has been used for a filter. However, it has recently been recognized to be usable as a soundproof material for a high speed railroad.

Namely, it is a well-known fact that recently a high speed electric car of particularly such a railroad as the Shinkansen accompanies not only a requirement for more speed but simultaneously a noise problem from the speed, and to cope with the latter problem some steps are urged to be taken from various aspects. Generally, a so-called sound absorbing material is said to be effective as a counter measure against the noise problem. However, it is required for a sound absorbing material for railroad use to have mechanical strength, heatproof property and weatherproof property, in addition to the sound absorbability. Therefore, no sound absorbing material to meet these demands has appeared yet. Namely, a countermeasure against noise is generally divided into sound interception and sound absorption. The former is to intercept a noise by the so-called intercepting board and the latter is to absorb a noise.

Though many of such sound absorbing materials are mainly made of glass fibers, etc., this kind of sound absorbing material mainly composed of glass fibers is said to have a defect in that it has poor mechanical strength and weatherproof property, and therefore it is especially difficult to install on a vehicle which is to run or vibrate, and difficult to position to directly absorb the noise from the source of sound itself, because the sound absorbing material is easy to break by an outer power such as an impact.

Under these circumstances, a porous alloy sintered body especially composed of a copper alloy has been given attention recently as a sound absorbing material because it is excellent in mechanical strength, weatherproof property and sound absorbability. In particular such a sound absorbing material has high mechanical strength and zigzag connecting pores therein. Thus, noises are considered to be absorbed because wave motion energy of the noises is changed into heat energy while they pass through said connecting pores.

However, a sound absorbing material of such construction is considerably restricted in its actual use because it is very expensive and heavy since said material is usually composed of a copper alloy group. This is said to be a defect of this sound absorbing material.

SUMMARY OF THE INVENTION

This invention is to provide a porous body which is free from the aforementioned defects encountered in the prior art, and the material of which is aluminum or aluminum alloy powder. The porous body is equal to or better than a porous body of copper alloy system in mechanical property and weather proof property. Also, said porous body is light and economical.

Another objection of this invention is to provide a manufacturing method of said porous body.

DESCRIPTION OF THE PREFERRED EMBODIMENTS

Figure 1:
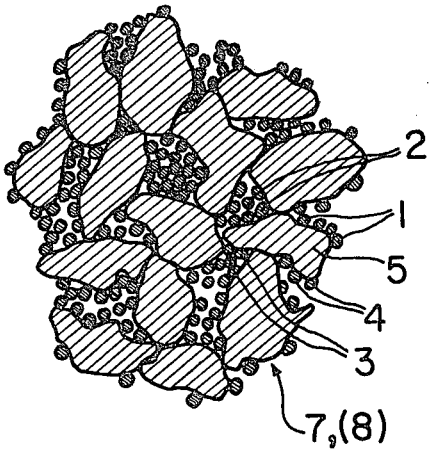
FIG. 1 is an enlarged sectional view showing a portion of the porous sintered body of this invention.

Initially, a base powder containing Al or Al and Cu or other Al alloy elements and being relatively large in the size of the powder particles is added and mixed with an Al alloy powder containing Cu or other alloy elements and having a melting point at least 10° C. lower than that of the base powder and more preferably being smaller than the base powder in the size of the powder particles.

Namely, in the present invention the base powder is made of aluminum or its alloy powder. The powder is mixed with another aluminum or its alloy powder, the melting point of which is lower than that of said base powder at least by about 10° C. For example, a base powder made of an Al-Cu alloy containing about 3wt% (hereinafter referred to simply as %) of copper is mixed with an Al-Cu alloy powder containing 50% of copper. When the mixed powder is heated up to 590° C. to 640° C., it is sintered partly in the liquid phase and a porous body can be formed as described later since the melting point of the mixing powder is about 585° C., while that of the base powder is about 650° C. or so.

Also, as another example of the base powder, instead of Al-Cu alloy powder, Al-Si alloy powder containing less than 1% of silicon and having the melting point of about 650° C. can be taken, and an Al-Si eutectic alloy powder containing 11% of silicon and having a melting point of 570° C. to 580° C. can be chosen to mix with said base powder. When those powders are mixed and heated up to 580° C. to 640° C., they can be sintered partly in the liquid phase.

Likewise, such a combination of a base powder and a mixing powder to mix therewith is applicable to other Al alloy combinations. For example, with an Al-Mg system alloy powder containing about 8% of magnesium and having a melting point of about 630° C., a low melting point Al-Mg alloy powder (the melting point, 550° C.) containing 20% of magnesium can be mixed.

After Al or its alloy base powder is mixed with another Al alloy powder, the melting point of which is lower than that of said base powder at least by 10° C. as mentioned above, the mixed powder is molded into a predetermined shape under a condition of substantial non-pressure. In this case it is necessary to supply pressure to some extent to maintain the molded shape. Contrarily, it is preferable that the pressure supplied be reduced as much as possible to enhance the pore ratio of the molded body. Accordingly, it is desirable to mold the mixed powder under pressure of $0.8\times10^{-3}$ kg/cm$^2$ or less. Further, molding under non-pressure can be effected by stuffing the mixed powder into a heatproof container and sintering it. Said mixed powder can be sintered because it is composed of at least of two kinds of Al alloy powder having different melting points from each other.

It is necessary that smoothness of diffusion be effected among the powder particles of the Al or its alloy during sintering, and sinterability is improved thereby in order to enhance the pore ratio and mechanical strength of the porous body.

However, the surface of an aluminum or aluminum alloy is extremely easily oxidized as compared with other metals, and in particular it is covered with an oxide film. Accordingly, aluminum or aluminum alloy powder with such an oxide film cannot be sintered. Usually, to sinter them, the oxide film was broken by giving a high compression on the powder to enhance the diffusibility among the powder particles during sintering. Therefore, it was impossible to make a highly sintered porous body with open pores of aluminum or its alloy powder, though it was possible to unify the powder and to make a body without open pores by sintering.

More detail concerning this point is mentioned herein. At present a porous sintered body is not made of aluminum or aluminum alloy powder, but is made of copper or copper alloy powder or iron or iron alloy powder, etc. A sintered body made of an aluminum or aluminum alloy is a compact body as is used for a ball bearing, etc. Recently a sintered body having pores therein to some extent was proposed, and this sintered body is used as an oil impregnating bearing because its pores impregnate oil, as mentioned in an official gazette of Japanese patent application Publication No. 24206/70. However, said body is actually almost compact because the pore ratio is about 20% at the utmost. Even in this method, importance is attached to the hard oxide film on aluminum or aluminum alloy powder on sintering. Namely, the aluminum or aluminum alloy powder is mixed with Al-Cu eutectic alloy powder. The mixture is compressed, for example, under pressure of $1.0\times10^3$ kg/cm$^2$ to break an oxide film thereon and then is sintered at a temperature between the melting point and the euctic point of aluminum and copper alloys. The oxides on the aluminum or aluminum alloy powder are, thus, partly broken by the pressure before sintering.

Further, because of the compression of aluminum or aluminum powder before sintering, in such a conventional method, not very many pores are produced and the pore ratio is 20% at most even though diffusion is effected among the mutual powder particles when sintering.

On the contrary, in the present invention, the base material composed of aluminum or aluminum alloy powder is mixed with a mixing aluminum alloy powder, the melting point of which is lower than that of said base material at least by 10° C., and the mixture is sintered at a temperature at which the lower melting point aluminum alloy powder is melted. Accordingly, when the mixture is molded under non-pressure, the lower melting point aluminum alloy powder is diffused in the liquid phase around the base material and acts as a kind of binder. As a result a sintered body with high pore ratio can be obtained.

Figure 2:
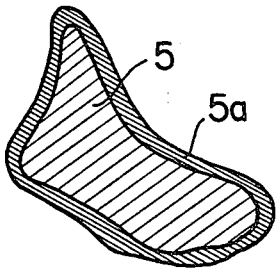
FIG. 2 and FIG. 3 are enlarged sectional views respectively showing a particle of a base material.
Figure 3:
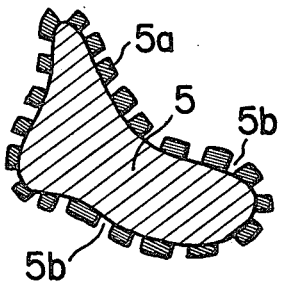

After molding the mixed powder under substantially non-pressure conditions as described above, the mold is heated and sintered at a temperature which is lower than the melting point of the base material at least by 10° C. and higher than the melting point of the mixing powder material in non-oxidizable atmosphere or inactive atmosphere. In this case the mixing powder material, for example, Al-Cu alloy powder is melted around the base material so that a porous sintered body with high mechanical strength and high pore ratio can be obtained.

Where the base material composed of aluminum or aluminum alloy powder is mixed with an aluminum alloy powder and/or granular material with a low melting point (hereinafter referred to as a low melting point material), it can be considered, as depicted in FIG. 1, that the low melting point materials 1,2,3 and 4 exist around the base material 5. In particular, where the low melting point materials 1,2,3 and 4 are smaller than the base material 5, the latter is surrounded by the former, and when heated in this state, an oxide film on the base material 5 cracks while the surrounding low melting point materials are melted. In other words, the surface of the base material 5 is covered with a relatively hard oxide film (see FIG. 2) 5*a* and expansion rate of the inside 5 is higher than that of the oxide film 5*a*, so that the oxide film 5*a* is broken and the inside is exposed out of the crack 5*b* as depicted in FIG. 3.

More particularly, the coefficient of expansion of aluminum or an aluminum alloy itself is considerably high in comparison with that of alumina ($Al_2O_3$), that is, four times as high as alumina. Further, the film of alumina is very thin, only about 100 Å thick. Because of this difference between both rates of expansion the film begins to crack slightly at a temperature of about 50° C. and such a tendency to crack becomes noticeable at about 150° C. At a sintering temperature said film is at least broken.

In a usual method of sintering of aluminum or an aluminum alloy, likewise, a surface oxide film on the surface thereof cracks and a new aluminum or aluminum alloy surface is exposed out of the crack. Aluminum or an aluminum alloy is extremely activated with oxygen particularly at a high temperature. Accordingly, even if a small amount of oxygen exists, the oxygen acts on the new surface out of the crack and oxidizes it, and an oxide film is formed thereon as soon as the film on the surface cracks. Thus, aluminum or an aluminum alloy can be usually considered to be always covered with an oxide film. For example, even if only about $6.3\times10^{-3}$ atm oxygen exists in a deoxidation atmosphere, an oxidation reaction proceeds, but formation of cracks, exposition of a new aluminum or aluminum alloy surface, etc. cannot be observed.

Contrarily, in the present invention, the atmosphere is held non-oxidizable almost completely, for example, considerably low in dew point, and in this atmosphere the low melting point materials 1,2,3 and 4 are melted and sintered around the base material 5.

For more detail, the melting point of each material 1,2,3 and 4 is lower than that of the base material at least by 10° C. Said low melting point materials are heated up to more than their melting point and act on the new exposed surface in the crack 5*b* of the base material 5 in a melting state and diffuse in the liquid phase when those materials are sintered. On this occasion, the low melting point materials diffuse in the liquid phase and leave pores to produce a porous sintered body.

Still more, it is necessary to form an alloy, that is, an α solid solution between a base material and a low melting point material in case the lower melting point material diffuses in the liquid phase and acts on the base material while in a melted state, as mentioned above. Thus, in view of both compositions a base material should be mixed with a low melting point material in the range of the alloy components of both materials at which an α solid solution can form.

Therefore, the low melting point material should preferably easily wet the base material and preferably form an α solid solution therewith, besides the melting point of the former being at least 10° C. lower than that of the latter. As an example, when Al or an Al-Cu alloy is chosen as a base material, an Al-Cu, Al-Mg or Al-Si alloy, etc. are preferably chosen as a low melting point material.

Also, aluminum or aluminum alloy powder is almost impossible to shape spherically and the powder particles are usually shaped pointedly at their tips. However, when manufactured as described above, tips of a base material are easy to melt and this material becomes so spherical that it is suitable for a filter, too.

In the present invention, as is apparent from the aforementioned description a porous sintered body, the pore ratio of which is 35 to 45%, is made of aluminum or aluminum alloys and has connecting pores in three dimensions among its powder particles, so that sound which enters into the porous body from its surface, even a high frequency sound can be absorbed almost completely. The body can be also used as a filter for waste fluid or the like.

Namely, as depicted in FIG. 1, the connecting pores are formed at each low melting point material 1,2,3 and 4. Those pores are also formed in the longitudinal direction though this is not depicted in FIG. 1 and are innumerably linked to each other laterally and longitudinally. Adjacent base materials 5 are mutually combined into a body in a part of their surfaces thereof so that connecting pores can be formed among those materials in three dimensions. Therefore, the sound from the surface of the material which enters into the connecting pores goes zigzag without going straight. While the sound passes through the connecting pores, the energy of the sound is lost. The reason is that the energy of the sound is changed into heat energy by the viscosity of air left inside the side walls of the connecting pores and the wave energy of the sound declines. In this case the aluminum or aluminum alloys are not spherical in shape but needle-like, oval, etc. and the shape of those connecting pores are also irregular and rugged. Since the air resistance in the pores is very high because of such projections or depressions, much of the energy of a sound is instantaneously absorbed and a low to high frequency sound can be considerably absorbed. Furthermore, where such connecting pores are almost endlessly crooked and irregular in section and rugged at every part, the quantity of the remaining air changes at every part. Therefore, the resistance of the air instantaneously changes every moment sound passes in the connecting pores and the sound is reduced conspicuously.

Also, the sound entering from the surface of the sintered body loses its energy when being hit against the side walls, etc. of the connecting pores and the sound absorbability is improved all the more because aluminum or its alloy powder has high internal friciton as compared with another metal such as iron, stainless steel, etc.

Still more, the inventors of the present invention examined the ratio of sound absorbability of a porous sintered body made of stainless steel powder with similar structure to the depicted powder in FIG. 1 and found said sintered stainless steel body was about 20% lower than the sintered body of aluminum or aluminum powder in the ratio.

The aforementioned porous sintered body can be also used as a filter if the size of the connecting pores therein is properly adjusted.

If, furthermore, the porous sintered body formed as a plate-shaped material is used for a sound absorbing apparatus, it is preferably used as mentioned below.

Figure 4:
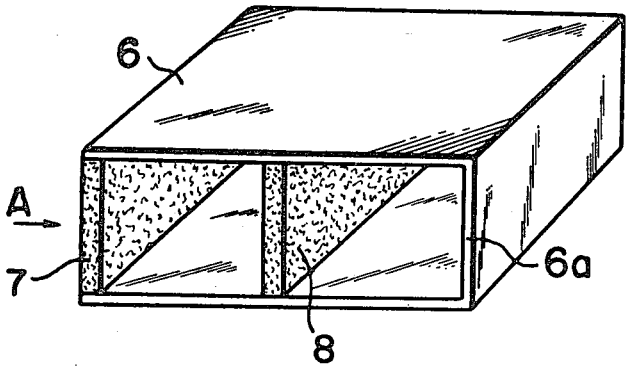
FIG. 4 is a perspective view showing an example of the sintered material of the present invention used as a sound absorbing apparatus.
Figure 5:
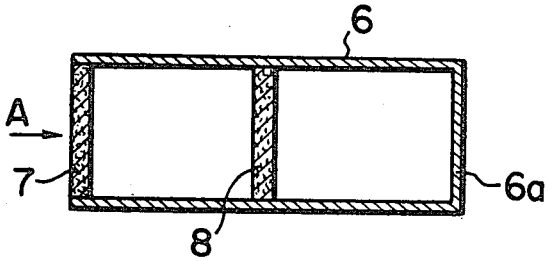
FIG. 5 is a vertical section of the apparatus depicted in FIG. 4.

Namely, FIG. 4 is a perspective view illustrating a mode of use of the sound absorbing apparatus. FIG. 5 illustrates a vertical section thereof. As depicted in FIG. 4 and FIG. 5, two pieces of the porous sintered materials 7 and 8 are placed apart from each other in a box-shaped frame 6. For example, where the waves of sound advance in the direction of the arrow A, the sound passes through the sintered material 7 and goes into the air between the materials 7 and 8 and then it enters into the sintered material 8. After that the sound is reflected by the frame 6 and passes through two pieces of the sintered materials 7 and 8 again. Thus, the energy of sound declined also by the existence of the air, and the ratio of the sound absorbability is sharply enhanced. Also, even in case only a piece of sintered plate is placed at an interval from the rear part 6*a* of the frame 6, sound can be fully absorbed.

EXAMPLE 1

Ninety two weight parts of aluminum powder being 20 to 2000 meshes in the average grading were mixed with 9 weight parts of a low melting point Al-Cu aluminum alloy being below 100 meshes in the average grading. The mixture powder was placed in a disc-shaped graphite die of 10 cm in diameter and 5 mm in depth were sintered at a temperature of 600° C. for 30 minutes. As a result the low melting point aluminum alloy powder changed the phase to that of liquid and a circle of sintered plate was obtained. In relation to this plate water passability was examined and it was well confirmed with the municipal water supply.

Further, the pore ratio of said sintered body proved to be about 43% because of a lot of pores formed by melting the low melting point aluminum alloy powder. The mechanical property of the tensile strength of said body proved to be 4 kg/mm$^2$.

EXAMPLE 2

Two pieces of the porous sintered materials obtained in Example 1 were placed at an interval of 50 mm and the ratios of the vertical incidence sound absorption in relation to the frequencies of sound were examined by means of projecting sound vertically to said dual materials. In this examination the maximum frequency of sound was 3150 Hz. As a result, the ratios of the vertical incidence sound absorption were as depicted in FIG. 6.

Figure 6:
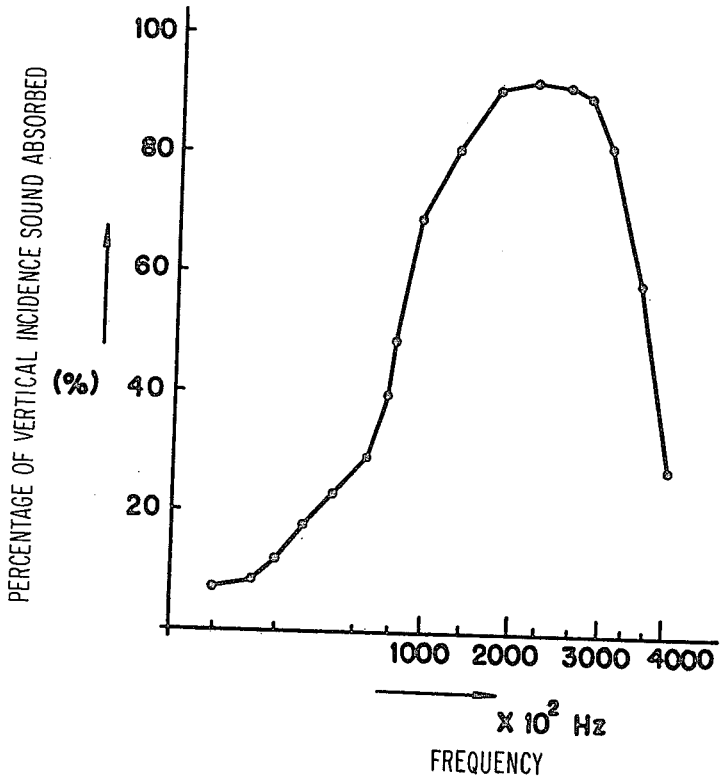
FIG. 6 is a graph showing a relationship between the frequency of sound and the ratio of the vertical incidence sound absorption of the porous sintered body of the present invention.

As is apparant from FIG. 6, the porous sintered materials of this invention could absorb a high frequency sound, for example, more than 80% of about 1000 to 2000 Hz sound and proved to be exceedingly suitable as a sound absorbing material. Further, a diesel sound, that is, about 800 to 1000 Hz sound was fully absorbed with said sintered material, which proved to be also very suitable as a sound absorbing material of this kind of sound. Still more, the relationship between the frequencies of sound and the ratios of the vertical incidence sound absorption was examined by means of changing the pore ratio of the connecting pores of said sintered material. As a result, at least 70% of about 1000 to 2000 Hz sound could be absorbed with said sintering material when the pore ratios were more than 30%. Accordingly, such a material with more than 30% pore ratio was suitable as a sound absorbing material.

EXAMPLE 3

Similarly to Example 1, the ratio of the vertical incidence sound absorption in relation to sound with different frequencies was examined with a porous sintered material being 2 to 7 mm thick and made in the same way as Example 1. As a result almost the same tendency was found when the material was more than 3 mm in thickness. The examination proved that said ratio was deteriorated with a low frequency sound and it rose with a high frequency sound as the material becomes thick.

EXAMPLE 4

In this example, the base material was aluminum alloy powder composed of 0.1% of magnesium, 0.1% of silicon, 1% of copper, 0.2% of manganese and the remainder aluminum. One hundred weight parts of the base material being 50 meshes in the average grading was mixed with 5 weight parts of aluminum alloy powder and granules being 100 meshes in the average grading, which was composed of 20% of magnesium and the remainder aluminum.

Next, the mixture powder was placed in a ceramic container and heated up to a temperature of 600° to 620° C. and sintered in a completely hydrogen atmosphere (−50° C. of dew point), particularly with flowing the hydrogen. In this case the melting point of the base material was 653° C. and that of the powder and granular material was 570° C.

The porous sintered body obtained was 3.2 kg/cm in tensile strength and 41% in pore ratio. The pores were all connected to each other.

We claim:

1. A porous body having excellent sound absorbing properties composed of a sintered body of stick-shaped, needle-shaped, oval-shaped or other irregular-shaped particles of a base material of aluminum or aluminum alloy powder and a second material of alumium alloy powder having a melting point at least 10° C. lower than the melting point of said base material, said porous body having a network of connecting pores communicating with the surface of said body with a pore ratio of 33 to 50% of the total volume of the body.

2. A method of manufacturing a porous body comprising the steps of mixing a base material of powder and/or granular aluminum or aluminum alloy with a second material of powder and/or granular aluminum alloy, the melting point of said second material being at least 10° C. lower than that of the base material, forming the mixture into a predetermined shape under a pressure of $0.8\times10^{-3}$ kg/cm$^2$ or less, and sintering said mixture in a nonoxidizing or inert atmosphere at a temperature which is at least 10° C. lower than the melting point of the base material and is higher than the melting point of the second material.

3. A porous body as in claim 1 made by a method comprising the steps of mixing a base material of powder and/or granular aluminum or aluminum alloy with a second material of powder and/or granular aluminum alloy, the melting point of said second material being at least 10° C. lower than that of the base material, forming the mixture into a predetermined shape under a pressure of $0.8\times10^{-3}$ kg/cm$^2$ or less, and sintering said mixture in a nonoxidizing or inert atmosphere at a temperature which is at least 10° C. lower than the melting point of the base material and is higher than the melting point of the second material.

4. A porous body as in claim 1 wherein the base material is aluminum and the second material is Al-Cu alloy.

5. A porous body as in claim 1 wherein the base material is aluminum and the second material is Al-Mg alloy.

6. A porous body as in claim 1 wherein the base material is aluminum and the second material is Al-Si alloy.

7. A porous body as in claim 1 wherein the base material is Al-Cu alloy. and the second material is Al-Cu alloy.

8. A porous body as in claim 1 wherein the base material is Al-Cu alloy and the second material is Al-Mg alloy.

9. A porous body as in claim 1 wherein the base material is Al-Cu alloy and the second material is Al-Si alloy.

10. A porous body as in claim 1 wherein the base material is Al-Mg-Si-Cu-Mn alloy and the second material is Al-Mg alloy.

11. A porous body as in claim 1 wherein the pore ratio is 35 to 45%.

* * * * *